US006070286A

United States Patent [19]

Cardarelli

[11] Patent Number: 6,070,286

[45] Date of Patent: Jun. 6, 2000

[54] ANGULATED TOOTHBRUSH

[76] Inventor: Venanzio Cardarelli, 20 N. Triangle Dr., Plymouth, Mass. 02360

[21] Appl. No.: 09/234,205

[22] Filed: Jan. 20, 1999

Related U.S. Application Data

[60] Provisional application No. 60/072,642, Jan. 27, 1998.

[51] Int. Cl.[7] ..... A46B 9/04

[52] U.S. Cl. ..... 15/167.1; 15/143.1; 15/114; 15/145; 15/172; 15/176.1; 15/176.2; 15/176.6; 15/201; D4/104; D4/112

[58] Field of Search ..... 15/110, 114, 143.1, 15/144.1, 145, 167.1, 167.2, 176.1–176.6, 201, 172; D4/104, 111, 112

[56] References Cited

U.S. PATENT DOCUMENTS

| | | | |
|---|---|---|---|
| D. 118,155 | 12/1939 | Bosak | D4/104 |
| D. 365,209 | 12/1995 | Plummer | D4/104 |
| D. 401,413 | 11/1998 | Porter | D4/104 |
| 1,369,966 | 3/1921 | Cosens et al. | 15/167.1 |
| 1,860,911 | 5/1932 | Trimble | 15/176.1 X |
| 2,719,998 | 10/1955 | Hibbs | 15/172 |
| 4,240,452 | 12/1980 | Jean | 15/167.1 |
| 4,399,582 | 8/1983 | Ernest et al. | 15/167.1 X |
| 4,463,470 | 8/1984 | Willis | 15/167.1 |
| 4,638,521 | 1/1987 | Potente et al. | 15/167.1 X |
| 5,305,490 | 4/1994 | Lundgren | 15/167.1 |
| 5,306,151 | 4/1994 | Rauch | 433/216 |
| 5,315,731 | 5/1994 | Millar | 15/167.1 |
| 5,323,504 | 6/1994 | McCusker | 15/167.1 |
| 5,396,679 | 3/1995 | Brown et al. | 15/167.1 |
| 5,522,109 | 6/1996 | Chan | 15/106 |
| 5,617,884 | 4/1997 | Allison | 15/167.1 |

FOREIGN PATENT DOCUMENTS

| | | | |
|---|---|---|---|
| 87/01263 | 3/1987 | WIPO | 15/167.1 |

*Primary Examiner*—Mark Spisich
*Attorney, Agent, or Firm*—D. Michael Burns

[57] ABSTRACT

A toothbrush which will alleviate stress through an angulated handle portion that has a series of coils located at its distal end. The distal end being connected to a mandolin shaped brush head which includes a center core material which acts to urge the bristles into a 45 degree angle of brushing. The head can be removed for cleaning or replacement by a screw shank connector. The screw shank connector includes a dominant component and an inferior component which will enable the user to be able to position the brush head at the desired working angle. The opposite end of the handle has grip which includes, a 360 degree serrated thumb rest on one end and a 360 degree hand stop at the other end.

14 Claims, 4 Drawing Sheets

FIG. 3
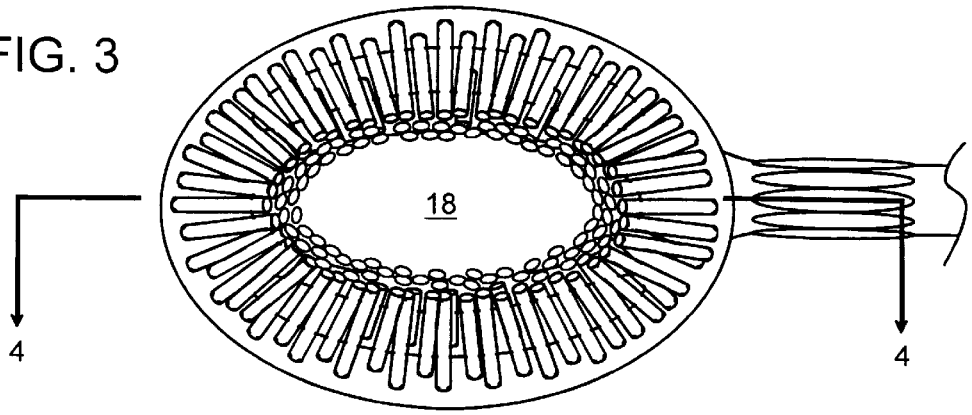
FIG. 4
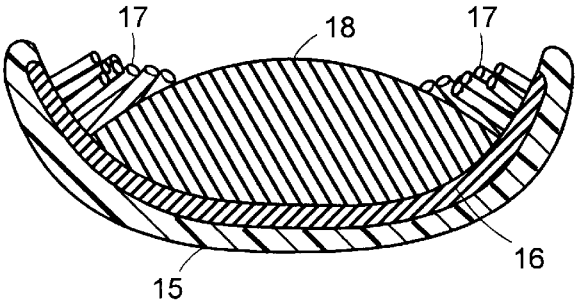
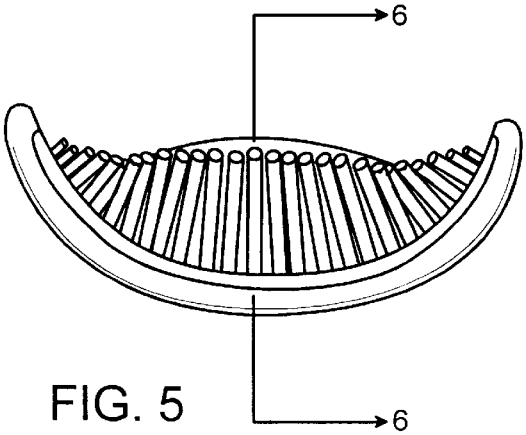
FIG. 5
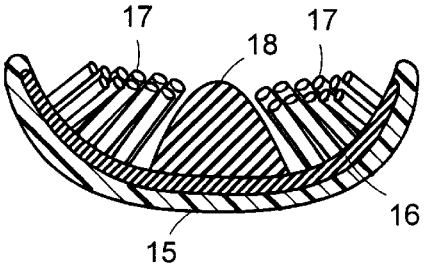
FIG. 6

ANGULATED TOOTHBRUSH

CROSS REFERENCE TO RELATED APPLICATION

This application is based on Provisional Patent Application Ser. No. 60/072,642, filed Jan. 27, 1998.

BACKGROUND OF THE INVENTION

1. Field of the Invention

The present invention relates generally to dental care products and more specifically to an angulated toothbrush with a replaceable brush portion. The present invention is particularly helpful for use in areas of the mouth that are difficult for standard toothbrushes to reach.

2. Description of the Prior Art

Many areas of the teeth and gums are inaccessible to a person using a standard toothbrush. Because of its straight bristle head, the standard toothbrush does not clean properly in the embrasure, buccal and lingual areas of the teeth. The result of these standard toothbrush shortcomings is an accumulation Plaque is calcified by ions in the saliva, and if they are not removed within a reasonable period of time (approximately 24 hours), they can only be removed thereafter by a dentist. Plaque and calculus are well known factors of tooth decay and periodontal disease. Although the incidence to tooth decay is decreasing, the increase in periodontal disease, now the leading cause of tooth loss in adults, clearly illustrates the failure of the standard toothbrush and demonstrates the need for an improved tool of oral prophylaxis.

Toothbrush designs are numerous, some are manual, some battery operated and others electrically powered. Some designs have fixed brush heads, often replaceable and interchangeable. Many designs have brush heads with scalloped bristles, some short and some long. Some toothbrushes will be seen in the prior art to have numerous rows of bristles while others will have just a few rows. There are many toothbrushes illustrating curved heads, curved handles and replaceable heads. One popular method of reducing stress is to incorporate swiggles in the narrowest part of the handle. All the above variables in toothbrushes will not work if the major problem in tooth hygiene is not systematically addressed. Pressure in dental hygiene is the major cause of sensitive teeth, abrasion and gum recession, because people generally do not brush properly. Most often people apply too much pressure while brushing, it is these forces that need to be controlled. Some people incorrectly believe that the harder they brush, the cleaner their teeth will be. This is not true and the damage to tooth care is far greater because of it. The present invention by its design seeks to reduce abrasion, reduce gingival recessing and to eliminate sensitivity. Sensitivity is caused by the dentin gradually being abraded by improper techniques of oral hygiene.

Accordingly, a need will be seen for a toothbrush which will alleviate these problems and accomplish the designed end result with the use of a single device. A discussion of the prior art, of which the present invention is aware, and the distinctions from the present invention is provided below.

U.S. Pat. No. 5,315,731 issued to Millar on May 31, 1994, teaches the use of a curved head with alternatingly arranged rows of short and long bristles. This patent to Millar shows the curved head surface being only one dimensional. The present invention utilizes a mandolin shaped head, which allows all the tufts of bristles to be directed at the teeth in a most efficient manner. Millar does not teach a center core in the head nor does he teach the need for a rubberized-like base for embedding the tufts.

U.S. Pat. No. 4,463,470 issued to Willis on Aug. 7, 1984, shows a pair of complementary right and left-handed toothbrushes, in which each brush has a handle and head. The handles have bends that complement each other in order to reach teeth in difficult areas of the mouth. The present invention solves all the above problems with the use of a single angulated toothbrush. It also improves the visibility for the user without the extra brush.

U.S. Pat. No. 4,240,452 issued to Jean on Dec. 23, 1980, teaches the use of an elastic base for embedding the bristle tufts. He specifically uses three elastic rubber tubes for allowing the bristle to contact with the teeth according to geometric tooth configurations. The present invention utilizes a rubber base embedded in the mandolin head but depends mainly on a center core material to insure complete uniform contact of the bristles to teeth.

Rauch discloses in U.S. Pat. No. 5,306,151 issued on Apr. 26, 1994, a toothbrush that depends on a symmetrical four-sided handle to maintain proper bristle to teeth position, which is about a 45° angle along the long axis of the teeth. Rauch utilizes a straight toothbrush while the present invention, with an angulated handle can reach areas of the mouth that cannot be reached very easily with a straight handle.

U.S. Pat. No. 5,522,109 issued to Chan on Jun. 4, 1996, discloses a double-headed toothbrush with multiple fixed angles to accomplish a complete hygienic brushing, especially around the buccal and lingual surfaces. The present invention does not require the need for two brushes.

U.S. Pat. No. 5,323,504 issued to McCusker on Jun. 28, 1994, teaches a non-resiliently deformable handle portion to change the angular relationship between the head and handle portions. The shape of the toothbrush may be changed by the user to adapt to his/her particular mouth shape; and if by any chance this angle is changed during brushing, it indicates excessive pressure by the user. The present invention acknowledges that excessive pressure is the leading problem of incorrect brushing techniques. The present invention solves this problem with a unique handle design which utilizing a series of coils around the thinnest part of the handle, which prevents the brusher from being able to exert excessive force. The design of the toothbrush automatically controls these forces.

None of the above inventions and patents, either singly or in combination, is seen to describe the instant invention as claimed.

SUMMARY OF THE INVENTION

Accordingly, the above problems and difficulties are obviated by the present invention which provides for an angulated toothbrush having a unique brush head and handle design. The brush head includes a mandolin shaped outer shell containing a combination bristle and center core section. The position of the handle in relationship to the brush portion is integrally maintained through an angulated shaft portion. This includes a series of coils at the narrowest point of the shaft, to reduce any stress that may be applied to the teeth. The handle has an octagonal faceted grip portion with a 360 degree stop and a 360 degree thumb rest. Another embodiment of the invention is a screw shank device whereby the brush head can be rotated. to any desired angle and also be able to remove the head for replacement.

Accordingly, it is a principal object of the invention to provide a toothbrush which gently reduces and prevents abrasion, periodontitis, sensitivity and tooth decay.

An object of the invention is to provide a toothbrush, which due to its angled design, is an inherent stress breaker. Excessive forces can not be applied on the brush, or else the brush will rotate in the hands of the user.

Another object of the invention is to provide increased visibility and greater area access for the user.

Still another object of the invention is to provide a toothbrush with a bristle density that allows the user to remove plaque with the highest efficiency in relation to the time spent brushing. This is accomplished by a mandolin shaped head with a center core embedded on a layer of rubber. The center core, in addition to forcing the bristles into the correct angular position, aids in the cleaning of the convex, concave and flat areas of the tooth.

Another object of the invention is a toothbrush having a brush head which can be easily and quickly rotated to the correct working angle. The screw shank device, besides allowing for the rotation of the brush head, can also disconnect the head for removal and replacement.

Another object of the invention is to prevent repeated sawing action (back and forth) which is destructive to the enamel and dentin. It is this motion which is most responsible for the iatrogenic affects such as abrasion, recession, periodontitis and sensitivity. The angle of the brush is so designed to minimize this motion.

It is yet still another object of the invention to provide an improved toothbrush, for the purposes described, which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a front view of the head showing bristles and center core.

FIG. 4 is a side cross-sectional view of FIG. 3 along line 4—4.

FIG. 5 is a side cross-sectional view showing the arrangement of bristles.

FIG. 6 is a cross-sectional of FIG. 5 along line 6—6.

Similar reference characters denote corresponding features consistently throughout the attached drawings.

DETAILED DESCRIPTION OF THE PREFERRED EMBODIMENT

Figure 1:
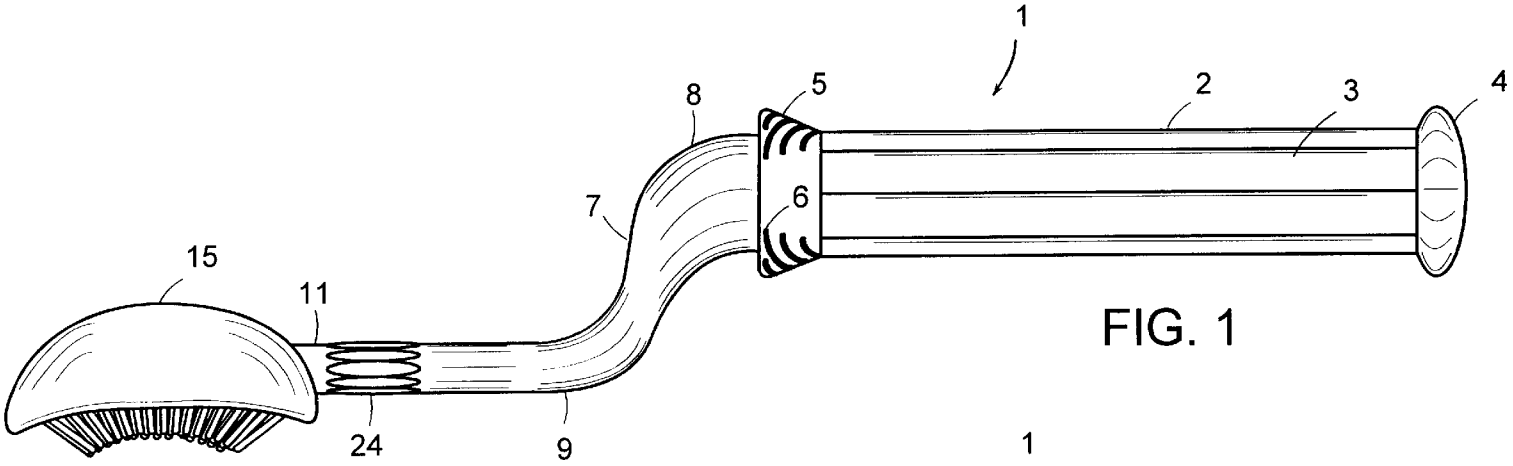
FIG. 1 is a front elevational view of the toothbrush.
Figure 2:
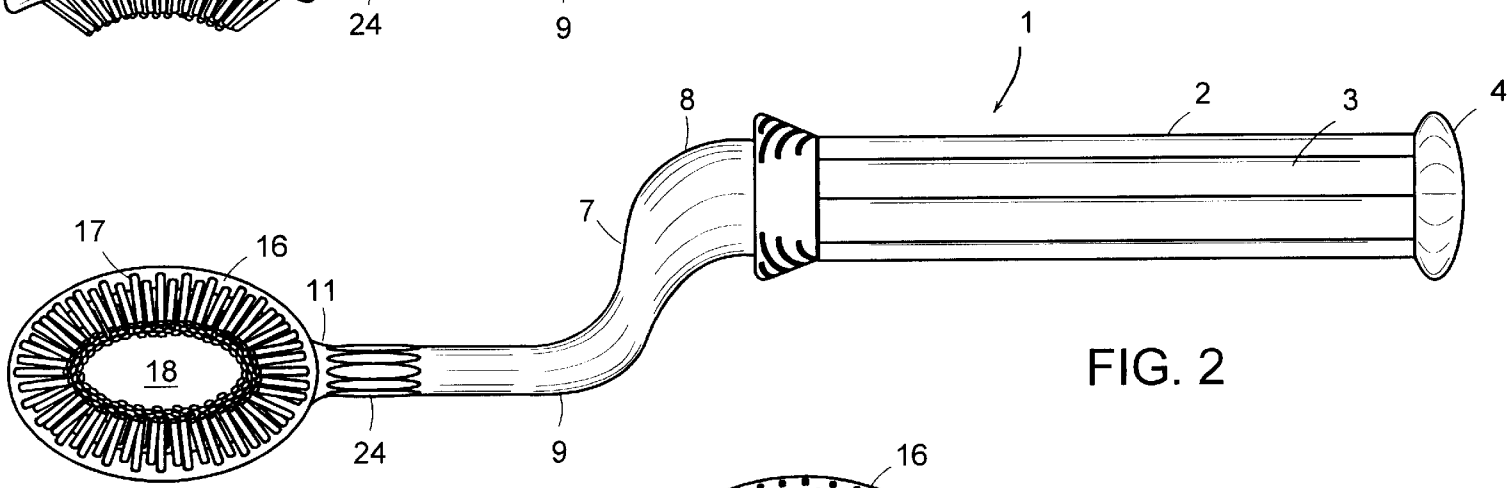
FIG. 2 is a bottom view of the invention in relation to the view of FIG. 1.
Figure 2A:
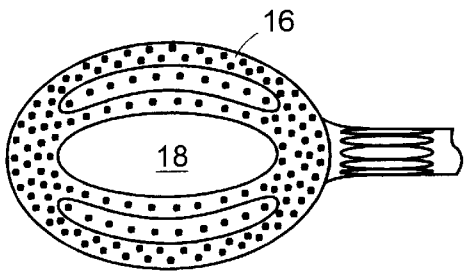
FIG. 2*a* is a cross-sectional view of the head of the device.

Referring now to the figures by numerals of reference and first to FIGS. 1–7, 1 denotes generally the angulated toothbrush device. For ease of manufacture and economy, the toothbrush 1 may be formed from one piece in the usual manner, typically plastic. The toothbrush 1 contains a handle portion 2, a brush head portion 15 and a shank portion 7 which integrally connects the handle 2 to the brush head portion 15. The handle portion 2 is comprised of an elongated, octagonal faceted grip section 3 with a 360 degree stop 4 at the distal end of the grip 3 and a 360 degree thumb rest 5 at the other end of the grip 3. The octagonal facets that make up the grip 3, are alternating surfaces of plastic and rubber. These facets improve the gripping aspect, especially with users suffering from arthritis or those users having physical handicaps effecting their manual dexterity. The stop 4 is a rest brace for the hands, while the thumb rest 5 allows the user to hold the toothbrush correctly. The thumb rest 5 has deposed on its surface a plurality of rubber touch pad serrations 6. These serrations 6 being of an anti-slipping nature. The shank portion 7 is integral with the proximal end of the handle 2. The shank 7 has an angulated thick section 8 closest to the thumb rest 5. The shank 7 then tapers and angulates to form an angulated thin section 9. The angulation is designed to enable the user to have increased visibility and control while brushing. The shank section 7 has extending from the thin section an elongated shaft section 10, with stress reducing coils 24 to reduce any excessive pressure that may be exerted during brushing. The shank 7 is integrally affixed to the mandolin shaped head 15 by a neck support 11. The brush head 15 has a resilient, concave inner shell base 16 defined by a layer of rubberized type material. The rubber elastomer base 16 can include such elastomers as low and high density polyethylene, tetrafluoroethylene (Teflon), polyurethane and polypropylene. Embedded into the layer 16 are bristles 17 which surround a central core 18. The bristles 17 having inner ends that can be secured to the resilient layer 16 in any suitable manner, including mechanical, adhesive or fusion means, as well as combinations thereof and injection molding techniques. The bristles 17 are arranged in columns extending longitudinally with respect to the head 15 and in rows extending transversely thereto, but as it is well known, the bristles 17 can be arranged in any desired pattern. The outer ends of the bristles 17 form an angle of about 45 degrees with the axis of the inner bristles 17 so that the bristles 17 will incline in response to the flexing of the resilient member 16. These bristles 17 aid in angulated brushing of the gingival-sulcular area of the tooth. The central core 18 can be felt, sponge, bristle, cloth, rubberized, or some other compressible and soft material which will maintain the angle of the bristles 17 to the teeth at the preferred angle which is about 45 degrees. In addition, the center core 18 aids in the cleaning of the convex/concave or flat areas of the teeth with minimal number of brushing strokes. The mandolin shape of the brush head 15 is geometrically designed to affect this angle. The bristle 17 can be nylon or some similar synthetic material. The rubberized bed 16 allows the bristles 17 and central core 18 to float and glide over the irregularities of the teeth. The entire brush head section 15 has been slightly exaggerated in size for illustrative purposes.

The combination of the angulated shape of the shank portion 7 and the coils 24 interposed at the thinnest angulated section 9 of the shank 7, will not allow the brusher to apply excessive forces that could be detrimental to the brushing process. The major cause of gum and teeth sensitivity, periodontitis and gingival recession of the gums is brushing too hard. The coils 24 are manufactured of the same plastic, or metal, as the rest of the brush. The toothbrush 1 is made of plastic material with rubberized stop 4, thumb rest 5 and resilient rubberized layer 16.

Figure 7:
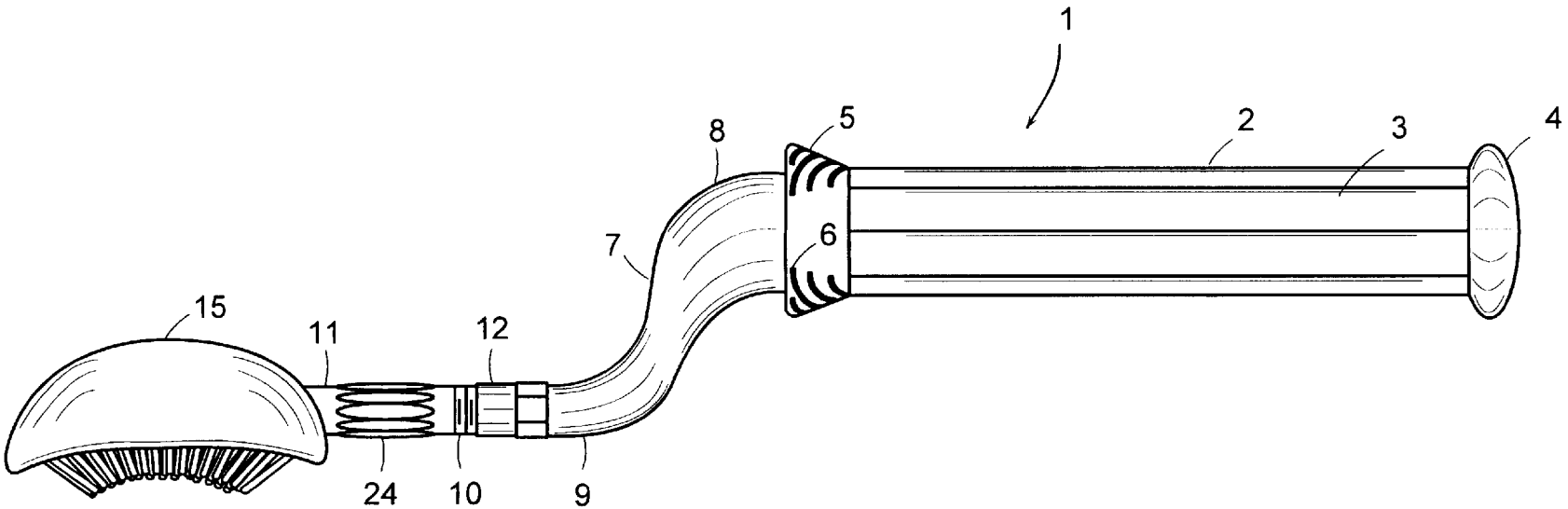
FIG. 7 is a frontal view of the toothbrush showing the screw shank device.
Figure 8:
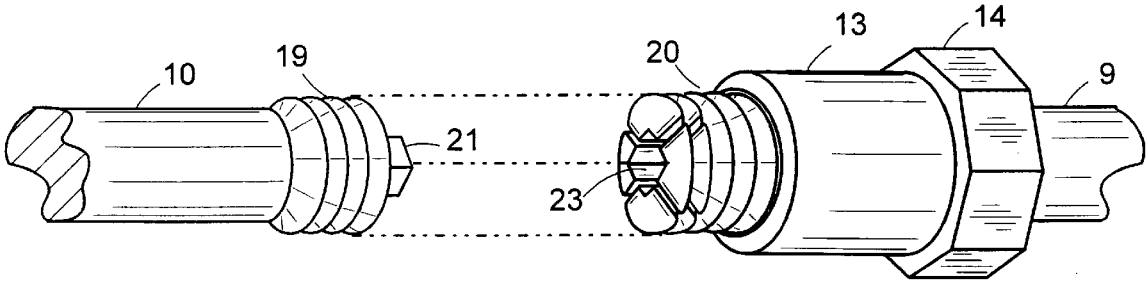
FIG. 8 is an expanded view of the screw shank device.
Figure 9:
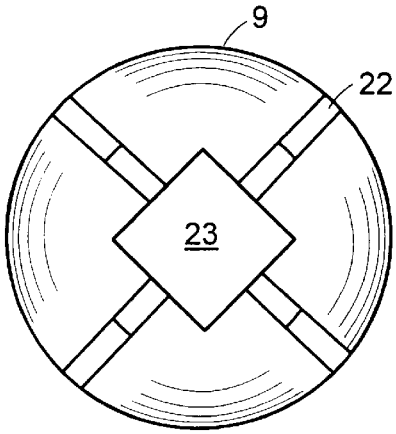
FIG. 9 is a view of the insertion area of the screw shank.

Referring to FIGS. 7, 8 and 9, there is depicted an alternative embodiment of the invention. This embodiment allows for the brush head 15 to be rotated, or removed for replacement. The elongated shaft section 10 has at one end a concentric first threaded member 19, having a square shaped insert 21. This entire removable portion connects to the angulated thin section 9, which has a concentric second threaded member 20, including an opening 23 for accepting the inset 21. A four-way slotted section 22 is shown in FIGS. 8 and 9. This section 22 can be used in conduction with a four-way protruding member (not shown) which can be used in lieu of the protruding insert 21. The entire brush head 15 can be rotated to the desired working angle and secured by a screw shank device 12 which is comprised of a dominant component 13 and an inferior component 14. Both components 13 and 14, having internal threads for fastening to the members 19 and 20. The dominant component 13 screws the two threaded members 19 and 20 together with the inferior component 14 providing the securing means of the device 12. This embodiment will allow for removal of the brush head 15, whenever it becomes necessary due to wear and tear, without the need to throw away the rest of the toothbrush. It also allows the user to rotate the brush head 15 to the angle most convenient for his brushing.

While one method is shown and described for rotating and removing the brush head portion 15, those skilled in the art will be aware of other ways of affixing the head 15 to the handle portion 2. It is anticipated that the head 15 could also have a disconnect fitting at the grip section 3. The present inventor knows that such methods as inserting circular depressions within an "O" ring, rotating cuff connectors such as when protruding members rotate into position within a 360 degree interior channel, or spring loaded button mechanisms which include ball bearings rotating into a circular chamber can also be used in lieu of the screw shank device 12.

In summary, the present toothbrush 1 will be seen to provide an extremely easy to use device that will help reduce tooth decay, sensitivity, abrasion, gingival recessing of the gums and periodontitis.

It is to be understood that the present invention is not limited to the sole embodiment described above, but encompasses all embodiments within the scope of the following claims.

I claim:

1. An angulated toothbrush comprising:

a handle portion;

a mandolin shaped brush head; and a shank portion having at one end a neck support integral with the brush head and at the other end a thick angulated section integral with the handle portion to form a working toothbrush;

the shank portion angulatingly tapering from the thick section down to an angulated thin section, a relatively elongated shaft section interconnecting the thin section with a neck support of the brush head;

a series of coils disposed at the thinnest point of the shaft section, whereby the coils aided by the angulated shape of the shank portion, prevent the user from being able to apply any excessive forces that could be detrimental to the brushing process.

2. The angulated toothbrush according to claim 1, wherein the toothbrush further includes a screw shank device for the removal or rotation of the brush head, the device including:

a first threaded member integral with the elongated shaft section, a square shaped insert protruding from the first member, a second threaded member integral with the angulated thin section, the second member having a surface defining an opening therein, the opening accepting the insert so as to connect the members;

a dominant component and an inferior component mounted on the angulated thin section, the dominant component capable of being twisted over the threaded members, whereby the toothbrush may be secured by biasing the inferior component against the dominant component.

3. The angulated toothbrush according to claim 1, wherein the handle portion includes:

an elongate octagonal faceted gripping section comprising alternative facets of rubber and plastic material;

the gripping section having a proximal end integral with the angulated thick section and a distal end;

a generally circular thumb rest encircling about the proximal end, the surface of the thumb rest defining a plurality of rubber touch pad serrations for aiding the user in holding the toothbrush; and a generally cylindrical stop on the distal end for resting the hand of the user during the brushing process.

4. The angulated toothbrush according to claim 3, wherein the toothbrush further includes a screw shank device for the removal or rotation of the brush head, the device including:

a first threaded member integral with the elongated shaft section, a square shaped insert protruding from the first member;

a second threaded member integral with the angulated thin section, the second member having a surface defining an opening therein, the opening accepting the insert so as to connect the members;

a dominant component and an inferior component mounted on the angulated thin section, the dominant component being capable of twisting over the threaded members, whereby the toothbrush may be secured by biasing the inferior component against the dominant component.

5. The angulated toothbrush according to claim 3, wherein the brush head includes:

a resilient concave elastomeric base, the base disposed within the mandolin brush head;

an oval compressible central core embedded in the elastomeric base, extending longitudinally with respect to the brush head; and, a plurality of bristles arranged in columns circumferentially about the central core, the bristles having inner ends embedded in a cooperating relationship with the central core to allow the outer ends to maintain a preferred angle of approximately 45 degrees with the axis of the mandolin shaped brush head, the central core and bristles responding to the flexing of the elastomeric base to float and glide over the irregularities of the teeth, whereby the gingival sulcular area of the tooth will be easily reached, and the central core can clean and massage the convex, concave and flat areas of the teeth with a minimum number of strokes.

6. The angulated toothbrush according to claim 5, wherein the toothbrush further includes a screw shank device for removal or rotation of the brush head in relation to the rest of the toothbrush, the device including:

a first threaded member integral with the elongated shaft section, a square insert protruding from the first member;

a second threaded member integral with the angulated thin section, the second member having a surface defining an opening therein, the opening accepting the insert so as to connect the members; and a dominant component and an inferior component mounted on the angulated thin section, the dominant component capable of being twisted over the threaded members, whereby the toothbrush can be secured by biasing the inferior component against the dominant component.

7. An angulated toothbrush comprising:

a mandolin shaped brush head;

a shank portion having one end integrally connecting to the brush head; and a handle portion having:

an elongate octagonal faceted gripping section comprising alternative facets of rubber and plastic material, the gripping section having a proximal end connected to the other end of the shank portion and a distal end;

a thumb rest generally encircling about the proximal end, the thumb rest having a surface defining a plurality of touch pad serrations for aiding the user in holding the toothbrush; and a generally cylindrical stop on the distal end for resting the hand of the user during the brushing process.

8. The angulated toothbrush according to claim 7, wherein the toothbrush further includes a screw shank device for the removal or rotation of the brush head, the device including:

a first threaded member, a square insert protruding from the first member;

a second threaded member, the second member having a surface defining an opening therein, the opening accepting the insert so as to connect the members; and a dominant component and an inferior component, the dominant component capable of being twisted over the threaded members, whereby the toothbrush can be secured by biasing the inferior component against the dominant component.

9. The angulated toothbrush according to claim 7, wherein the brush head includes:

a resilient concave elastomeric base, the base disposed within the mandolin brush head;

an oval compressible central core embedded in the elastomeric base, extending longitudinally with respect to the brush head; and a plurality of bristles arranged in columns circumferentially about the central core, the bristles having inner ends embedded in a cooperating relationship with the central core thereby allowing the outer ends to maintain a preferred angle of approximately 45 degrees with the axis of the mandolin shaped brush head, the central core and bristles responding to the flexing of the elastomeric base to float and glide over the irregularities of the teeth, whereby the gingival sulcular area of the tooth will be easily reached, and the central core can clean and massage the convex, concave and flat areas of the teeth with a minimum number of strokes.

10. The angulated toothbrush according to claim 9, wherein the toothbrush further includes a screw shank device for the removal or rotation of the brush head, the device including:

a first threaded member, a square insert protruding from the first member;

a second threaded member, the second member having a surface defining an opening therein, the opening accepting the insert so as to connect the members; and a dominant component and an inferior component, the dominant component capable of being twisted over the threaded members, whereby the toothbrush can be secured by biasing the inferior component against the dominant component.

11. An angulated toothbrush comprising:

a handle portion;

a shank portion integrally connected to the handle portion; and a mandolin shaped brush head having:

a resilient concave elastomeric base, the base disposed within the mandolin brush head;

an oval compressible central core embedded in the elastomeric base, extending longitudinally with respect to the brush head; and a plurality of bristles arranged in columns circumferentially about the central core, the bristles having inner ends embedded in a cooperating relationship with the central core to allow the outer ends to maintain a preferred angle of approximately 45 degrees with the axis of the mandolin shaped brush head, the central core and bristles responding to the flexing of the elastomeric base to float and glide over the irregularities of the teeth, whereby the gingival sulcular area of the tooth will be easily reached, and the central core can clean and massage the convex, concave and flat areas of the teeth with a minimum number of strokes.

12. The angulated toothbrush according to claim 11, wherein the toothbrush further includes a screw shank device for removal or rotation of the brush head in relation to the rest of the toothbrush, the device including:

a first threaded member, a square insert protruding from the first member;

a second threaded member, the second member having a surface defining an opening therein, the opening accepting the insert so as to connect the members; and a dominant component and an inferior component, the dominant component capable of being twisted over the threaded members, whereby the toothbrush can be secured by biasing the inferior component against the dominant component.

13. The angulator toothbrush according to claim 11, wherein the shank portion includes:

a neck support at one end integral with the brush head and. a thick angulated section intergral with the handle portion to form a working toothbrush;

the shank portion angulatingly tapering from the thick section down to an angulated thin section, a relatively elongated shaft section interconnecting the thin section with a neck support of the brush head;

a series of coils disposed at the thinnest point of the shaft section, whereby the coils aided by the angulated shape of the shank portion, prevent the user from being able to apply any excessive forces that could be detrimental to the brushing process.

14. The angulated toothbrush according to claim 13, wherein the toothbrush further includes a screw shank device for removal or rotation of the brush head, the device including:

a first threaded member integral with the elongated shaft section, a square insert protruding from the first member;

a second threaded member integral with the angulated thin section, the second mamber having a surface defining an opening therein, the opening accepting the insert so as to connect the members; and a dominant component and an inferior component mounted on the angulated thin section, the dominant component capable of being twisted over the threaded members, whereby the toothbrush can be secured by biasing the inferior component against the dominant component.

* * * * *